United States Patent [19]

Dhanjal

[11] Patent Number: 4,757,324

[45] Date of Patent: Jul. 12, 1988

[54] ANTENNA ARRAY WITH HEXAGONAL HORNS

[75] Inventor: Sutinder S. Dhanjal, Hamilton Township, Mercer County, N.J.

[73] Assignee: RCA Corporation, Princeton, N.J.; General Electric Company, East Windsor, N.J.

[21] Appl. No.: 41,394

[22] Filed: Apr. 23, 1987

[51] Int. Cl.[4] ..... H01Q 13/02

[52] U.S. Cl. ..... 343/776; 343/770; 343/786

[58] Field of Search ..... 343/772, 776, 778, 786

[56] References Cited

U.S. PATENT DOCUMENTS

| | | | |
|---|---|---|---|
| 2,206,683 | 7/1940 | Wolff | 343/776 |
| 2,851,686 | 9/1958 | Hagaman | 343/786 |
| 3,243,713 | 3/1966 | Brahm | 328/227 |
| 3,633,208 | 1/1972 | Ajioka | 343/786 |
| 4,527,165 | 7/1985 | deRonde | 343/778 |

FOREIGN PATENT DOCUMENTS

| | | | |
|---|---|---|---|
| 1441093 | 8/1973 | Fed. Rep. of Germany | 343/786 |
| 3,331,023 | 3/1985 | Fed. Rep. of Germany | 343/786 |
| 0030302 | 3/1981 | Japan | 343/786 |

*Primary Examiner*—William L. Sikes
*Assistant Examiner*—Doris J. Johnson
*Attorney, Agent, or Firm*—Clement A. Berard, Jr.; William H. Meise

[57] ABSTRACT

An array of flared horn antennas is adapted to be fed from circular waveguide. The apertures of the horns are closely spaced. Prior art horns with circular apertures leave gaps in the aperture. The gaps are eliminated, and the gain of the array is increased by about ½ dB by tapering the horns from a circular cross-section at the feed end to a hexagonal cross-section at the radiating aperture end.

8 Claims, 4 Drawing Sheets

ANTENNA ARRAY WITH HEXAGONAL HORNS

This invention relates to arrays of electromagnetic antennas, and more particularly to arrays of horn antennas.

In order to obtain high directivity of electromagnetic energy, it is common to use antenna arrays. At frequencies above 1 GHz, the elements of the array may desirably be in the form of electromagnetic horns. U.S. Pat. No. 4,527,165, issued July 2, 1985 to deRonde, describes a planar array of rectangular horns arranged for radiating circularly polarized signals. Those skilled in the antenna arts realize that antennas may be viewed as transducers between radiated fields and guided fields, and that the operations of transmitting and receiving are reciprocal functions. The descriptions of the operation of antennas, however, may be couched in terms of only transmission or only reception. Hereinafter, the description is couched in terms of transmission.

The deRonde arrangement radiates in two orthogonal linear polarizations, but because of the asymmetry of a rectangular aperture, may not radiate a beam in a symmetrical manner for the two linear polarizations, resulting in different beam widths and therefore gains. In the context of transmission of an ideally circularly polarized beam, the differences in gain for its components may result in elliptical rather than circular polarization.

The problem of asymmetry of response of the rectangular horn array element may be corrected by the use of a circular horn aperture. U.S. Pat. No. 3,633,208, issued Jan. 4, 1972 to Ajioka, describes an array of closely spaced circular horn antennas. FIG. 1 illustrates the Ajioka array. It includes a plurality of small conical horns 16–23 spaced about a larger central conical horn 10, all supported by a mounting disc 12. In this arrangement, the diameters of the apertures of the smaller horns 16–23 are selected to be 0.618 times the diameter of the larger horn so as to have the smaller horns touching each other.

FIG. 2 is a view of the aperture ends of an array of nine closely spaced circular horns 216–224 of equal diameter. In this context, closely spaced means that the array configuration is selected so that a given number of horns occupy the minimum area in the plane of the radiating apertures. This maximizes the gain of the aperture occupied by the array. As illustrated in FIG. 2, each centrally located horn, such as horn 220, is surrounded by six other horns (216, 217, 219, 221, 222, 223). Each centrally located horn, such as horn 220, is also surrounded by six interstitial gaps, numbered 266, 267, 269, 271, 272, 273. These interstitial gaps do not radiate. Consequently, a portion of the area of the array is occupied by nonfunctional interstices. If the interstices could be utilized, the gain of the array would increase by the proportion of the area gained, which is about 6%, corresponding to about ½ dB. This amount of gain can be very important in some contexts.

SUMMARY OF THE INVENTION

An antenna array includes a plurality of flared horns having feed and radiating aperture ends. The cross-section of each of the horns is circular at or near the feed end. The aperture ends of the horns are closely spaced in the array. Each horn makes a transition from a circular cross-section at the feed end to a regular hexagonal cross-section at the aperture end. In one embodiment, the transition is tapered. The close spacing of the hexagonal apertures eliminates gaps in the aperture.

DESCRIPTION OF THE INVENTION

Figure 1:
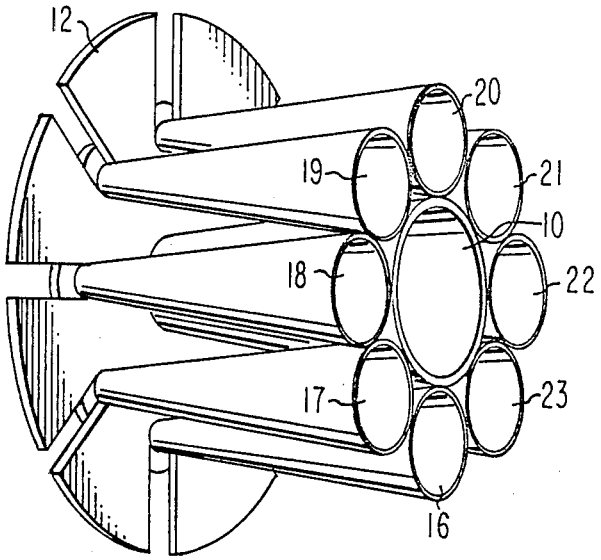
Fig. 1 PRIOR ART
FIG. 1 is a perspective view of a prior art flared horn array.
Figure 2:
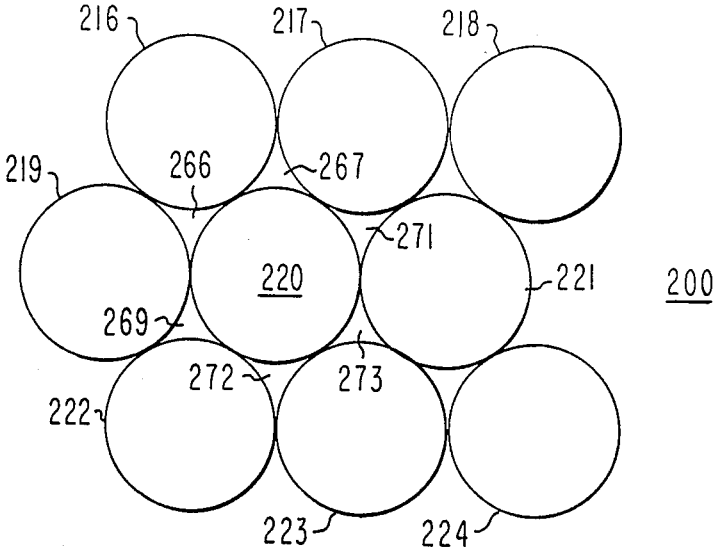
FIG. 2 is an aperture-end view of an array of circular horns, illustrating gaps in the array aperture.
Figure 3:
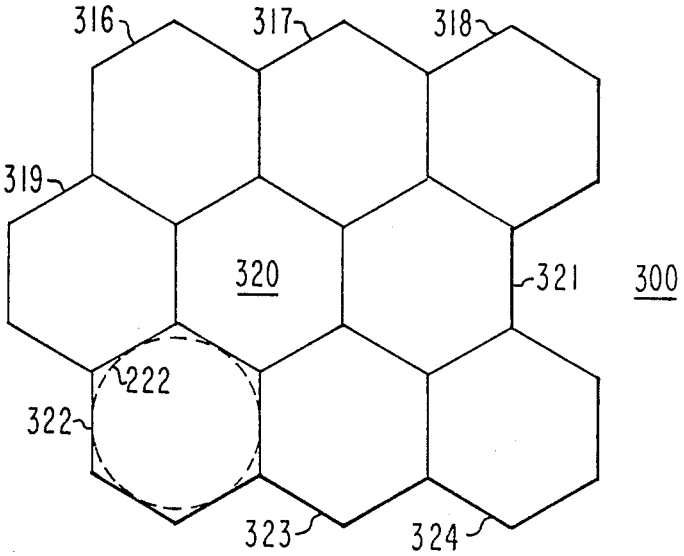
FIG. 3 is an aperture-end view of an array according to the invention, illustrating that close spacing of the hexagons eliminates the gaps.

FIG. 3 is a view of the radiating aperture end of an array 300 of hexagonal radiating aperture 316–324. A dashed circle 222 is inscribed within hexagonal aperture 322, illustrating that the aperture 322 is in the shape of a hexagon circumscribed about the circle representing aperture 222, and therefore the arraying dimension (the distance between adjacent centers of radiating apertures) is the same in both arrays 200 and 300. However, no interstitial gaps occur in the case of array 300. Consequently, the entire area is utilized, and the gain of array 300 is about ½ dB greater than that of array 200 of FIG. 2.

While the hexagonal radiating apertures 316–324 are not as symmetrical as circular radiating apertures, they are more symmetrical than rectangular apertures. Thus, as to an array of circular apertures, the gain of the hexagonal array of FIG. 3 is greater, and compared to an array of rectangular apertures, the hexagonal array has a more symmetrical response to varying polarization.

Figure 4B:
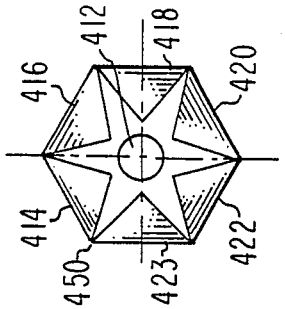
FIGS. 4*a*, 4*b*, and 4*c*, referred to together as FIG. 4, are side aperture-end elevation views, and a cross-section, respectively, of a horn suited for use in the array of FIG. 3.
Figure 4A:
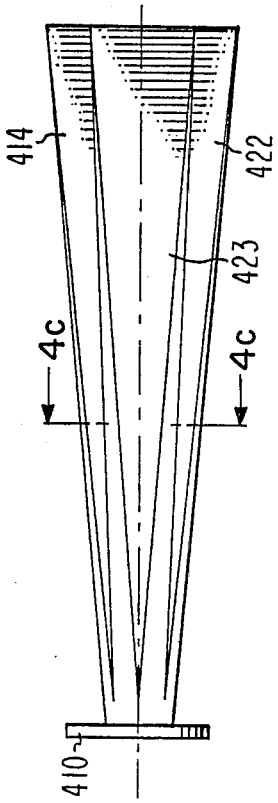
Figure 4C:
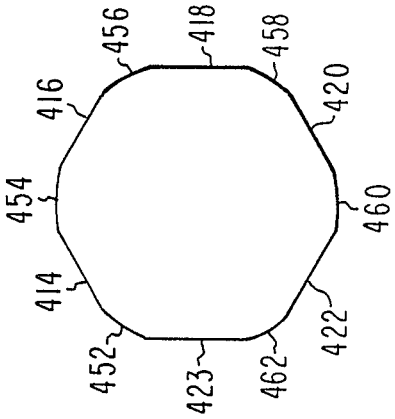

FIG. 4*a* is a side elevation view of a horn element 400 suited for inclusion to produce an array having an aperture such as that of FIG. 3. FIG. 4*b* is a view looking into the larger, radiating aperture end at the right of horn antenna 400 as illustrated in FIG. 4*a*. At the left of FIG. 4*a*, antenna 400 terminates in a standard waveguide flange 410 adapted to be coupled to a source of signal to be radiated. Flange 410 defines a circular waveguide aperture visible as aperture 412 of FIG. 4*b*. As illustrated in FIG. 4*b*, the hexagonal aperture is defined by six flat or planar walls, 414–423, only three (414, 422, and 423) of which are visible in FIG. 4*a*. The "points" of the hexagonal shape illustrated in FIG. 4*b*, such as point 450 between walls 414 and 423, make a transition into a circular shape. This is more clearly illustrated in the cross-section of FIG. 4*c*, taken at section lines C-C of FIG. 4*a*, in which flat walls 414 and 423 are separated by a radius curved portion 452. At the radiating aperture (the right end of the horn as illustrated in FIG. 4*a*), the arc subtended by curve 452 has been reduced to zero, and the curve therefore appears as point 450 (FIG. 4*b*). At cross-sections closer to the feed end (the left end of FIG. 4*a*), than the cross-section of FIG. 4*c*, the arc subtended by curve 452 increases, and the widths of adjacent flat walls 414 and 423 decrease, until the widths of the flat walls decrease to zero at the feed end. At the feed end, radius curved segment 452 joins adjacent curved segments 454 and 462, and in a like manner all other curved segments 456, 458 and 460 join to form a continuous circular cross-section. Thus, the transition between the circular feed-end cross-section and the hexagonal aperture-end cross-section is accomplished in the arrangement of FIG. 4 by a gradual taper.

For operation near 13 GHz, the aperture end of horn 400 has a dimension between opposing flat sides of the cross-section of about one inch (25.4 mm), a feed end circular waveguide diameter of about 6/10 inch (15 mm), and an overall length of about 6 inches (150 mm).

Figure 5A:
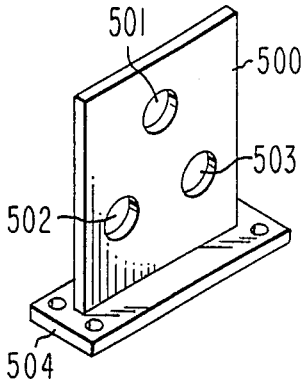
FIGS. 5*a* and 5*b*, referred to together as FIG. 5, illustrate in perspective view, a support arrangement adapted for supporting horns similar to the horn of FIG. 4, and the use of the support arrangement in conjunction with a pair of horns, respectively.
Figure 5B:
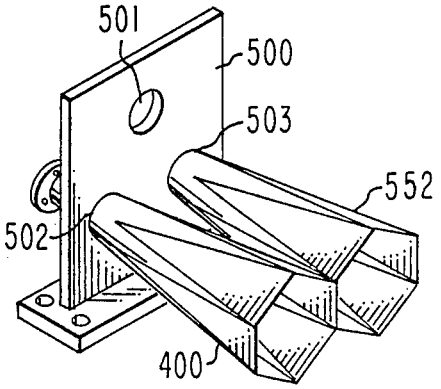

FIG. 5*a* is a perspective view of a mounting arrangement for holding three horns such as the horn illustrated in FIG. 4. Mounting plate 500 of FIG. 5*a* includes three apertures 501, 502, and 503, and is connected to a base 504. The arrangement of FIG. 5*a* is used as illustrated in FIG. 5*b*. In FIG. 5*b*, horn 400 is inserted through hole 502, and another similar horn is inserted through hole 503. No third horn is illustrated, to enhance clarity. The third horn, if shown, would be inserted into aperture 501. The flat sides of the apertures of horns 400 and 552 are contiguous, i.e., immediately adjacent to each other and touching or almost touching. As noted in the de-Ronde patent, the walls of the horns should be as thin as possible in order to maximize gain. The aperture of a third horn, if illustrated, would lie in the same plane as the aperture of horns 400 and 552, and two flats of the hexagonal aperture of the third horn would nest with horns 400 and 552, one side adjacent a side of each. In practice, the aperture ends of the horns may be fastened, for example, by welding, to enhance rigidity.

Other embodiments of the invention will be apparent to those skilled in the art. For example, any number of horns may be arrayed, and many different types of feed arrangements may be used, including coaxial cables with appropriate coax-to-waveguide transitions.

What is claimed is:

1. An antenna array comprising:

a plurality of flared horns, each of said flared horns including a smaller feed end and a larger aperture end, each of said flared horns being adapted to be coupled to one of a plurality of circular waveguide ports for receiving signal to be transmitted, each of said flared horns having a circular cross-section at said feed end and a regular hexagonal cross-section at said aperture end and a taper therebetween; and mounting means coupled to said plurality of flared horns for arraying said plurality of flared horns with said aperture ends contiguous.

2. An antenna array according to claim 1, wherein the walls of each of said flared horns near said aperture end have equal thickness, whereby both the inner and outer cross-section are hexagonal.

3. An antenna array according to claim 1, wherein said aperture end of each of said flared horns has a dimension between opposing flat sides of said regular hexagonal cross-section of about one inch (25.4 mm) for operation at frequencies near 13 GHz.

4. An antenna array according to claim 3, wherein said feed end of each of said flared horns has a diameter of about six-tenths of an inch (15 mm).

5. An antenna array according to claim 3, wherein the length of each of said flared horns between said feed and aperture ends is about six inches (150 mm).

6. An antenna array, comprising:

a plurality of flared conductive horns, each of said flared horns including a smaller feed end having a circular cross-section and also including a larger radiating aperture end, said radiating aperture ends being closely spaced with the radiating apertures of a maximum number of adjacent flared conductive horns, whereby if the cross-sections of said flared conductive horns at said radiating aperture end were to be circular, the array would have interstitial gaps which would reduce the gain of the array; and a transition associated with each of said flared conductive horns, said transition being between said circular cross-section at said feed end and a regular hexagonal cross-section at said radiating aperture end, whereby when said radiating aperture ends of said flared conductive horns are closely spaced, said interstitial gaps are substantially eliminated and the gain of said array is increased.

7. An array according to claim 6 wherein said transition associated with each of said flared horns comprises a continuous taper.

8. An antenna array comprising:

a plurality of horns having hexagonal cross-sections at their radiating apertures;

mounting means for mounting said plurality of horns with their apertures closely spaced; and feed means coupled to said plurality of horns for transducing energy.

* * * * *